US008640383B1

(12) United States Patent
Kunz

(10) Patent No.: US 8,640,383 B1
(45) Date of Patent: Feb. 4, 2014

(54) SYSTEM AND METHOD FOR RETAINING A PROPER INTERCONNECTION BETWEEN A TILT-POST AND A BRAKE SHOE IN THE COUNTERBALANCE SYSTEM OF A TILT-IN WINDOW

(71) Applicant: John R. Kunz, Douglassville, PA (US)

(72) Inventor: John R. Kunz, Douglassville, PA (US)

(73) Assignee: John Evans' Sons, Inc., Lansdale, PA (US)

( * ) Notice: Subject to any disclaimer, the term of this patent is extended or adjusted under 35 U.S.C. 154(b) by 0 days.

(21) Appl. No.: 13/655,406

(22) Filed: Oct. 18, 2012

(51) Int. Cl.
*E05D 15/22* (2006.01)
*E05F 1/00* (2006.01)

(52) U.S. Cl.
USPC ..... 49/181; 49/446

(58) Field of Classification Search
USPC ..... 49/176, 181, 445–447, 453; 16/193, 16/197
See application file for complete search history.

(56) References Cited

U.S. PATENT DOCUMENTS 4,718,194 A * 1/1988 FitzGibbon et al. ..... 49/181
4,887,389 A * 12/1989 Haltof ..... 49/181
5,069,001 A * 12/1991 Makarowski ..... 49/176
5,127,192 A * 7/1992 Cross ..... 49/181
5,243,783 A 9/1993 Schmidt et al.
5,371,971 A * 12/1994 Prete ..... 49/380
6,032,417 A * 3/2000 Jakus et al. ..... 49/181
6,041,475 A * 3/2000 Nidelkoff ..... 16/193
6,658,794 B1 * 12/2003 Hansel et al. ..... 49/181
6,983,513 B2 * 1/2006 Pettit ..... 16/197
7,210,267 B2 * 5/2007 VerSteeg et al. ..... 49/181
7,587,787 B2 * 9/2009 Pettit ..... 16/197
7,726,073 B2 * 6/2010 Ifko ..... 49/181
2002/0116786 A1 * 8/2002 Guillemet et al. ..... 16/197
2006/0230682 A1 * 10/2006 Ifko ..... 49/181
2007/0256462 A1 * 11/2007 VerSteeg et al. ..... 70/90

* cited by examiner

*Primary Examiner* — Katherine Mitchell
*Assistant Examiner* — Scott Denion
(74) *Attorney, Agent, or Firm* — LaMorte & Associates, P.C.

(57) ABSTRACT

A counterbalance system for a tilt-in window that utilizes a brake shoe assembly. The brake shoe assembly is comprised of a brake shoe housing and a cam element. The brake shoe housing has a first arm element, a second arm element, and a flexible bottom section. A cam opening is disposed within the brake shoe housing. A gap space exists above the cam opening. The cam element is disposed within the cam opening. The cam element contains a tilt post receiving slot that received the tilt post from a window sash. A catch finger extends from the first arm element into the gap space. The catch finger at least partially obstructs the tilt post receiving slot. This prevents the tilt post of the window sash from being inadvertently lifted out of the brake shoe assembly.

14 Claims, 7 Drawing Sheets

SYSTEM AND METHOD FOR RETAINING A PROPER INTERCONNECTION BETWEEN A TILT-POST AND A BRAKE SHOE IN THE COUNTERBALANCE SYSTEM OF A TILT-IN WINDOW

BACKGROUND OF THE INVENTION

1. Field of the Invention

In general, the present invention relates to counterbalance systems for windows that prevent open window sashes from moving under the force of their own weight. More particularly, the present invention system relates to the structure of the brake shoe component of counterbalance systems for tilt-in windows.

2. Description of the Prior Art

There are many types and styles of windows. One of the most common types of window is the double-hung window. Double-hung windows are the window of choice for most home construction applications. A double-hung window consists of an upper window sash and a lower window sash. Either the upper window sash or the lower window sash can be selectively opened and closed by a person sliding the sash up and down within the window frame.

A popular variation of the double-hung window is the tilt-in double-hung window. Tilt-in double-hung windows have sashes that can be selectively moved up and down. Additionally, the sashes can be selectively tilted into the home so that the exterior of the sashes can be cleaned from within the home.

The sash of a double-hung window has a weight that depends upon the materials used to make the window sash and the size of the window sash. Since the sashes of a double-hung window are free to move up and down within the frame of a window, some counterbalancing system must be used to prevent the window sashes from always moving to the bottom of the window frame under the force of their own weight.

For many years, counterbalance weights were hung next to the window frames in weight wells. The weights were attached to the window sashes using a string or chain that passed over a pulley at the top of the window frame. The weights counterbalanced the weight of the window sashes. As such, when the sashes were moved in the window frame, they had a neutral weight and friction would hold them in place.

The use of weight wells, however, prevents insulation from being packed tightly around a window frame. Furthermore, the use of counterbalance weights on chains or strings cannot be adapted well to tilt-in double-hung windows. Accordingly, as tilt-in windows were being developed, alternative counterbalance systems were developed that were contained within the confines of the window frame and did not interfere with the tilt action of the tilt-in windows.

Modern tilt-in double-hung windows are primarily manufactured in one of two ways. There are vinyl frame windows and wooden frame windows. In the window manufacturing industry, different types of counterbalance systems are traditionally used for vinyl frame windows and for wooden frame windows. The present invention is mainly concerned with the structure of vinyl frame windows. As such, the prior art concerning vinyl frame windows is herein addressed.

Vinyl frame, tilt-in, double-hung windows are typically manufactured with guide tracks along the inside of the window frame. Brake shoe assemblies, commonly known as "shoes" in the window industry, are placed in the guide tracks and ride up and down within the guide tracks. Each sash of the window has two tilt pins or tilt posts that extend into the shoes and cause the shoes to ride up and down in the guide tracks as the window sashes are opened or closed.

The shoes contain a brake mechanism that is activated by the tilt post of the window sash when the window sash is tilted inwardly away from the window frame. The shoe therefore locks the tilt post in place and prevents the base of the sash from moving up or down in the window frame once the sash is tilted open. Furthermore, the shoes engage curl springs. Curl springs are constant force coil springs that supply the counterbalance force to the weight of the window sash. Brake shoes are designed to easily receive the tilt post of the window sash as the tilt-in window is being assembled at the factory. Unfortunately, many prior art designs that enable the brake shoe to receive a tilt post also make it possible for the tilt post to accidentally exit the brake shoe as a person manipulates the sash during tilting. If the tilt post exits the brake shoe, the brake shoe may retract to the top of the window track because of the force of the counterbalance springs. Alternatively, the tilt post may rest upon the top of a brake shoe rather than inside the brake shoe. This prevents the brake shoe from functioning properly. It also can prevent a window sash from closing properly. Both scenarios require that the tilt-in window be serviced before it will again function properly.

In the prior art, brake shoes have been designed with locking features that enable a tilt post to enter the brake shoe, but prevent that tilt post from inadvertently exiting the brake shoe. Such prior art brake shoe designs are exemplified by U.S. Pat. No. 5,243,783 to Schmidt, entitled Locking Slide Block, and U.S. Pat. No. 6,658,794 to Hansel, entitled Guide Assembly For A Tilt-Out Sash Window. Such prior art designs require that catch locks be assembled into the structure of the brake shoe. This complicates the structure of the brake shoe, thereby making the shoe impractical to mold as a single piece. Rather, the brake shoe must be manufactured as a multi-part unit that must be assembled before it can be utilized in the structure of a tilt-in window. This adds significantly to the costs associated with producing and installing brake shoes. Furthermore, the presence of the catch lock complicates the removal of the sash from the window frame when the sash needs to be removed or replaced. Often the catch lock must be removed from a brake shoe using tools. In such a situation, a serviceman or homeowner would rarely reinstall the catch lock after it is removed. From that point onward, the tilt posts within the window are at risk of inadvertently separating from the brake shoes and disabling the functionality of the window.

A need therefore exists in the field of vinyl, tilt-in, double-hung windows, for a counterbalance system with a brake shoe that can actively retain a tilt post, yet remain both simple and inexpensive to manufacture. A need also exists for a brake shoe that actively retains a tilt post, yet can be caused to release a tilt post without tools or disassembly. These needs are met by the present invention as described and claimed below.

SUMMARY OF THE INVENTION

The present invention is a brake shoe assembly and its components that are use in a counterbalance system for a tilt-in window. The brake shoe assembly is comprised of a brake shoe housing and a cam element. The brake shoe housing has a first arm element, a second arm element, and a flexible bottom section that joins the first arm element to the second arm element. A cam opening is disposed within the brake shoe housing. Furthermore, a gap space exists between the first arm element and the second arm element above the cam opening.

The cam element is disposed within the cam opening. The cam element contains a tilt post receiving slot that receives the tilt post from a window sash. The cam element can be selectively rotated within the brake shoe housing between a first orientation and a second orientation as the tilt-in window is tilted.

A catch finger extends from the first arm element into the gap space. The catch finger at least partially obstructs the tilt post receiving slot when the cam element is in its second orientation. This prevents the tilt post of the window sash from being inadvertently lifted out of the brake shoe assembly. However, it enables the tilt post to be intentionally removed provided a sufficient and sustained lifting force is applied.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

The claimed features of the present invention brake shoe can be incorporated into many window counterbalance designs. However, the embodiment illustrated shows only one exemplary embodiment of the counterbalance system for the purpose of disclosure. The embodiment illustrated is selected in order to set forth one of the best modes contemplated for the invention. The illustrated embodiment, however, is merely exemplary and should not be considered a limitation when interpreting the scope of the appended claims.

Figure 1:
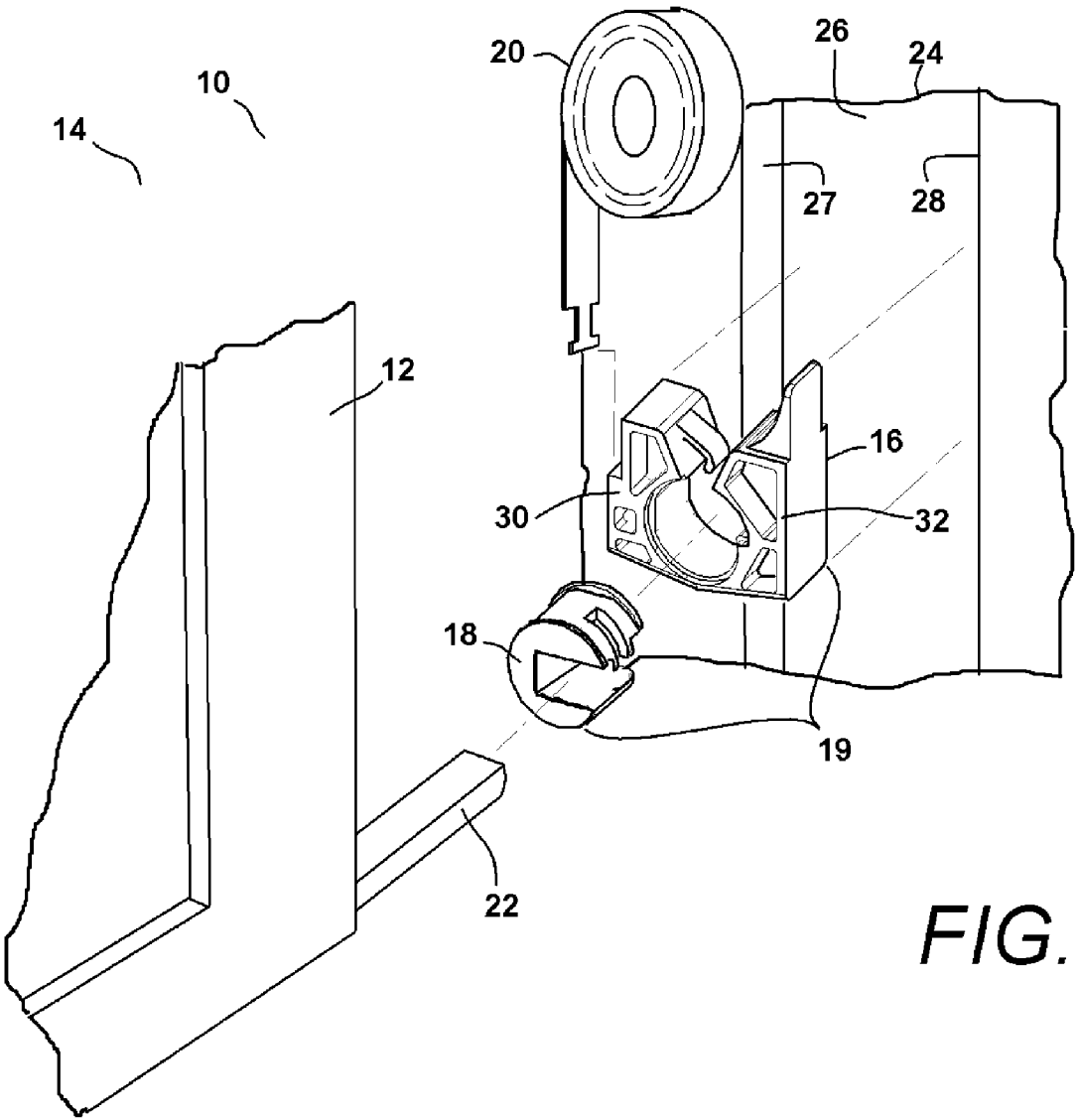
FIG. 1 is an exploded perspective view of a section of a tilt-in window assembly containing a counterbalance system in accordance with the present invention.
Figure 2:
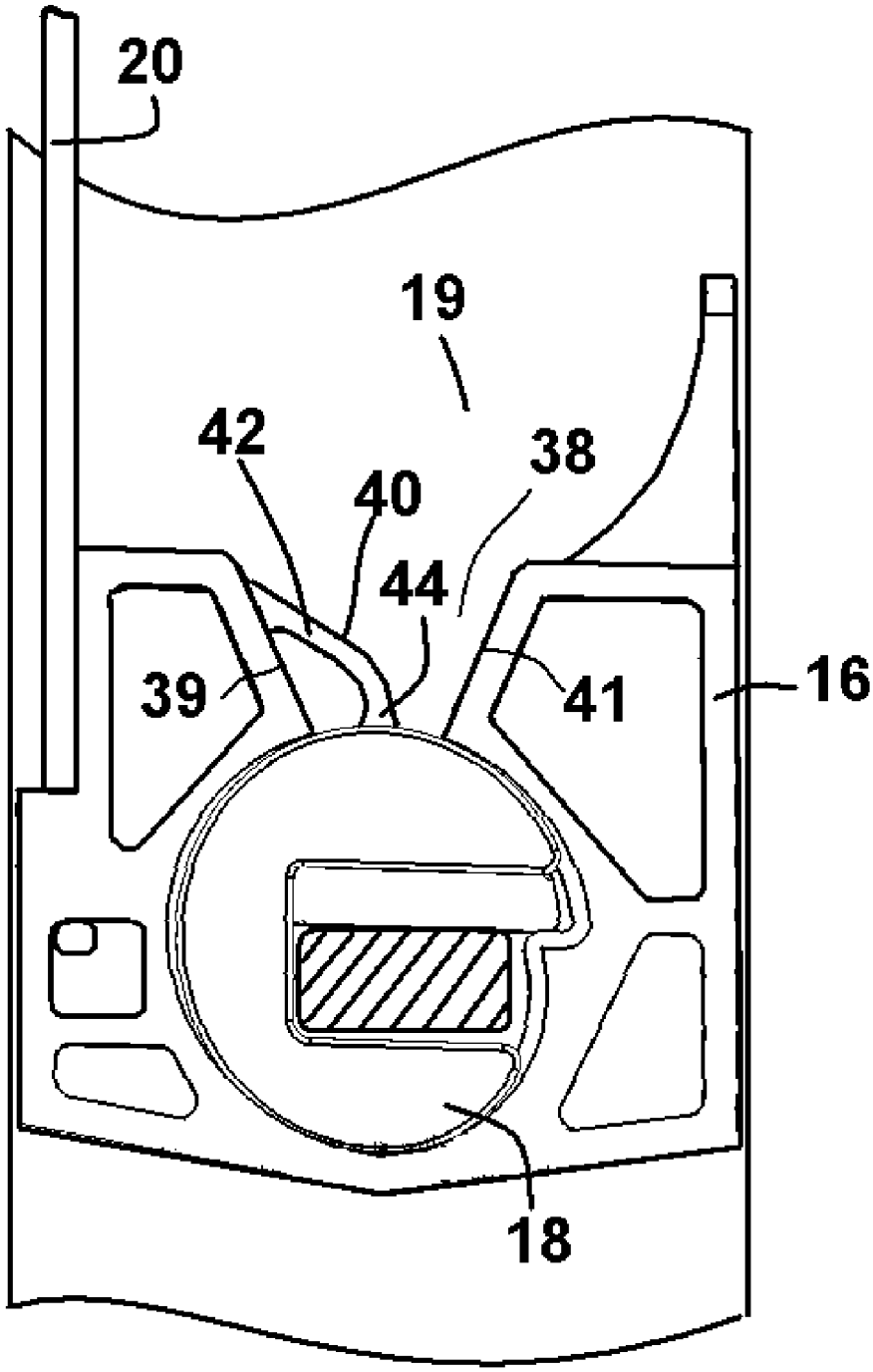
FIG. 2 is a cross section of the embodiment of the counterbalance system shown in FIG. 1, viewed along line 2-2.

Referring to FIG. 1, in conjunction with FIG. 2, there is shown an exemplary embodiment of a counterbalance system 10 that is used to counterbalance the sashes 12 contained within a window assembly 14. The counterbalance system 10 utilizes a brake shoe housing 16, a cam element 18, and at least one coil spring 20 on either side of each window sash 12. The brake shoe housing 16 engages a tilt post 22 that extends from the bottom of the window sash 12. As the window sash 12 is opened and closed, the brake shoe housing 16 travels up and down in vertical guide tracks 24. It will be understood that each window sash 12 typically utilizes two counterbalance systems on opposite sides of the sash 12. However, for the sake of simplicity and clarity, only one counterbalance system 10 is illustrated.

The brake shoe housing 16 receives the cam element 18 to form a brake shoe assembly 19. The brake shoe assembly 19 rides up and down in its guide track 24. The brake shoe assembly 19 is biased upwardly within the guide track 24 by at least one coil spring 20. The guide track 24 has a rear wall 26 and two side walls 27, 28. Te brake shoe assembly 19 is sized to be just narrow enough to fit between the side walls 27, 28 of the guide track 24 without causing excessive contact with the guide track 24 as the brake shoe assembly 19 moves up and down with the window sash 12.

Figure 3:
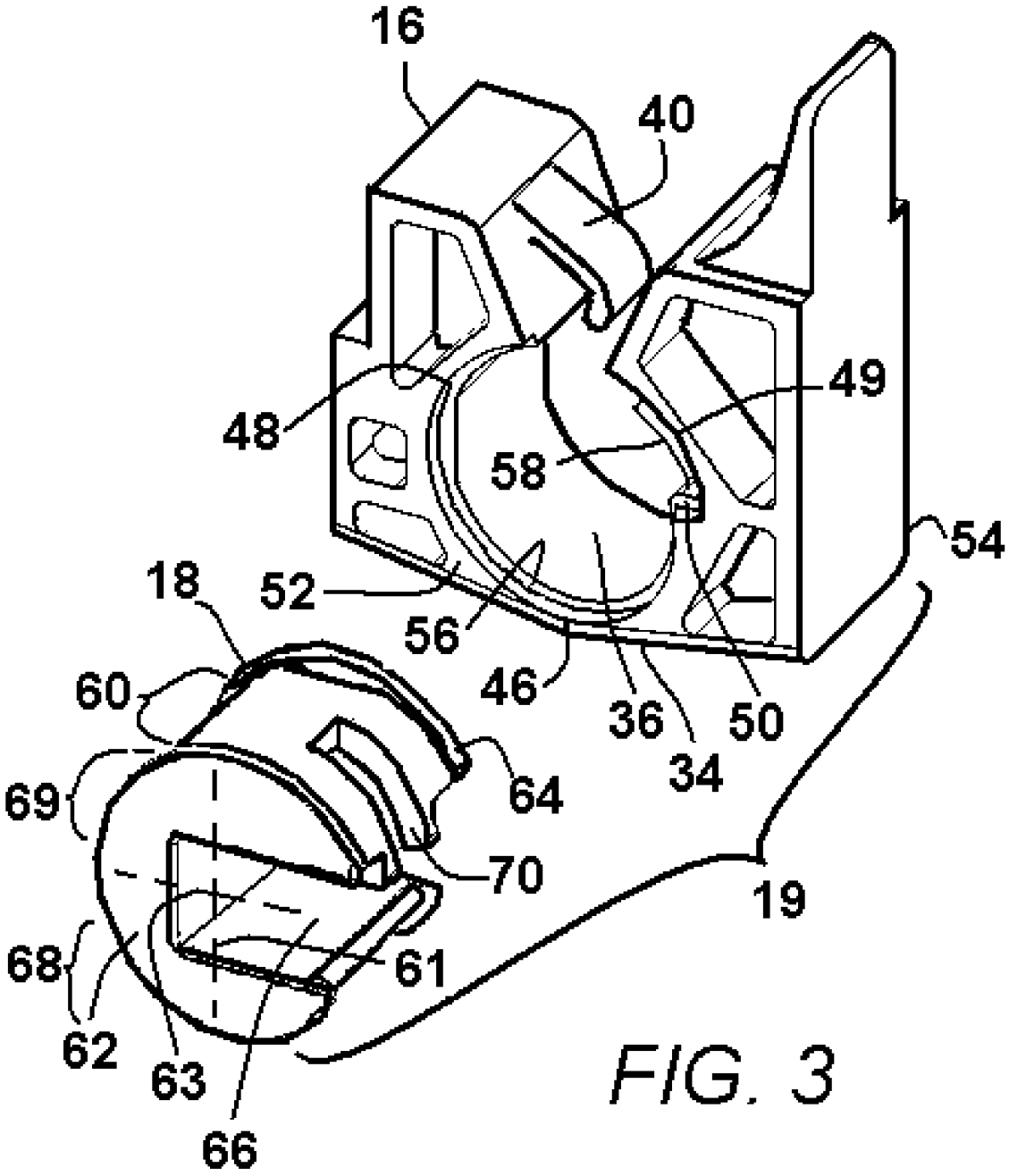
FIG. 3 is an exploded perspective view of the brake shoe housing and cam element of the counterbalance system.

Referring to FIG. 3 in conjunction with FIG. 1 and FIG. 2, it can be seen that the brake shoe housing 16 is a unistructurally molded unit that requires no assembly. The brake shoe housing 16 is generally U-shaped, having a first arm element 30 and a second arm element 32 that are interconnected by a thin bottom section 34. In the shown embodiment, the coil spring 20 attaches to the first arm element 30.

A generally circular cam opening 36 is formed between the first arm element 30, the second arm element 32 and the bottom section 34. Above the cam opening 36, the first arm element 30 and the second arm element 32 are separated by a gap space 38. The first arm element 30 has a first sloped surface 39 that faces the gap space 38. Likewise, the second arm element 32 has a second sloped surface 41 that faces the gap space 38. Taken together, the first sloped surface 39 and the second sloped surface 41 diverge away from each other as they ascend above the cam opening 36. The result is that the gap space 38 has tapered sides that lead into the cam opening 36.

A catch finger 40 protrudes from the first sloped surface 39 of the first arm element 30. The catch finger 40 extends into the gap space 38 between the first arm element 30 and the second arm element 32. The catch finger 40 is integrally molded as part of the first arm element 30 and the overall brake shoe housing 16. The catch finger 40 has a first section 42 that extends away from the first sloped surface 39 at an acute angle. This causes the catch finger 40 to extend in a downward direction. The catch finger 40 then curves into a nearly vertical orientation proximate its free end 44. The free end 44 is molded to be slightly bulbous in order to prevent the catch finger 40 from hanging up on the tilt post 22, as will later be explained.

The cam opening 36, although generally circular, is not round. Rather, the cam opening 36 has a rounded bottom section 46. On the first arm element 30, the rounded bottom section 46 transitions into a first curved section 48 that has a larger radius of curvature than the rounded bottom section 46. On the opposite second arm element 32, there is a second curved section 49 with the same general radius of curvature as the first curved 48 section. However, the second curved section 49 does not transition directly into the rounded bottom section 46. Rather, the second curved section 49 is offset from the rounded bottom section 46 with a flat ridge 50. The flat ridge 50 acts as a stop for the cam element 18, as will later be explained.

The brake shoe housing 16 has a face surface 52 and a rear surface 54. The cam opening 36 extends from the face surface 52 back to the rear surface 54. The dimensions of the cam opening 36 decrease just behind the face surface 52 and the rear surface 54 of the brake shoe housing 16. The decreases in dimensions create ledges 56 in the cam opening 36 just behind the face surface 52 and the rear surface 54. The ledges 56 are used to help retain the cam element 18, which will be later described in more detail.

A key projection 58 protrudes into the cam opening 36 from the second curved section 49. The key projection 58 is positioned approximately midway between the face surface 52 and the rear surface 54. Again, the key projection 58 is used to help retain the cam element 18, which will be later described in more detail.

The cam element 18 is generally cylindrical in shape. The cam element 18, however, does not have a circular cross-sectional profile. Rather, the cross-sectional profile of the cam element 18 is oblong, being mildly elliptical in its general shape. The cam element 18 has a midsection 60 positioned between a front flange 62 and a back flange 64. The midsection 60 of the cam element 18 has a long axis 61 and a short axis 63 when viewed in cross-section from either end. The front flange 62 and the back flange 64 are slightly larger than the midsection 60, therein providing the cam element 18 with a slight spool configuration.

A tilt post receiving slot 66 is formed in the cam element 18. The receiving slot 66 extends from the front flange 62 to the back flange 64. However, the receiving slot 66 is not symmetrically positioned. Rather, the receiving slot 66 is eccentrically positioned, so that the receiving slot 66 is closer to one side of the cam element 18 than to the other. For the purposes of this description, the side of the cam element 18 that contains most of the receiving slot 66 shall be referred to as the narrow side 68 of the cam element 18. Conversely, the side of the cam element 18 that does not retain much of the receiving slot 66 is referred to as the wide side 69 of the cam element 18.

A groove 70 is formed in the exterior of the midsection 60 of the cam element 18 in the wide side 69 of the cam element 18. The groove 70 is sized to receive the key projection 58 formed into the cam opening 36.

Figure 4:
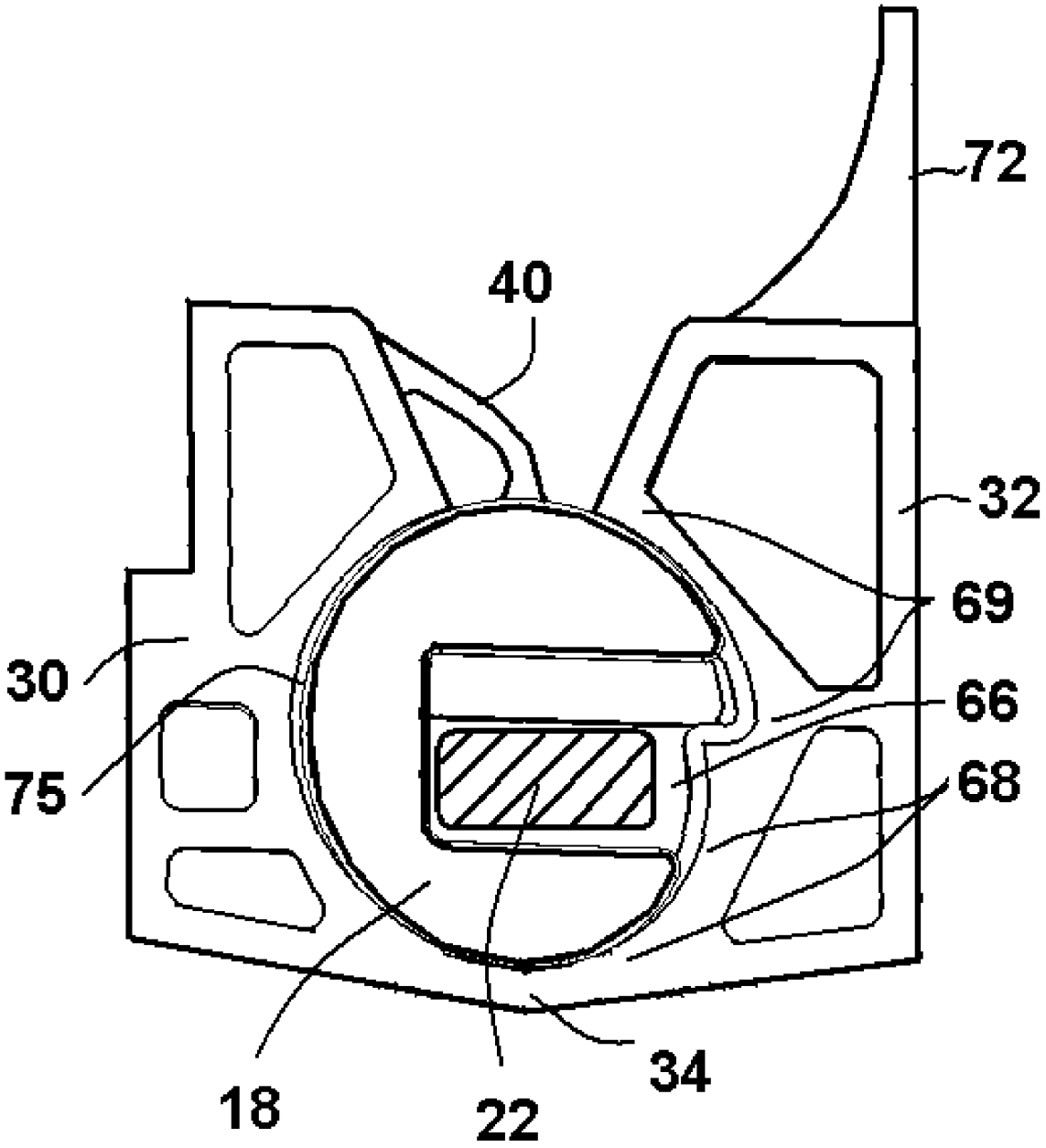
FIG. 4 is a front view of the brake shoe housing and cam element shown with the cam element holding a tilt post of a vertically oriented window sash.

Referring to FIG. 4, in conjunction with FIG. 1 and FIG. 3, it can be seen that the cam opening 36 receives and retains the cam element 18. During manufacture in the factory, the cam element 18 is inserted into the cam opening 36 by forcing the cam element 18 into the gap space 38 between the first arm element 30 and the second arm element 32 of the brake shoe housing 16. When pressed into the gap space 38, the cam element 18 spreads the first arm element 30 and the second arm element 32 apart. This is achieved by the elastic flexing of the thin bottom section 34 of the brake shoe housing 16, which acts as a living hinge. The cam element 18 also elastically deforms the catch finger 40 down until the cam element 18 passes. Once the cam element 18 is inside the cam opening 36, the first arm element 30 and the second arm element 32 rebound to their original positions. Likewise, the catch finger 40 returns to its original orientation. The presence of the catch finger 40 helps hinder the removal of the cam element 18 from the cam opening 36.

Once the cam element 18 is displaced into the cam opening 36 of the brake shoe housing 16, the front flange 62 and the back flange 64 of the cam element 18 engage the ledges 56 inside the cam opening 36 and prevent the cam element 18 from exiting the cam opening 36 either through the face surface 52 of the brake shoe housing 16 or the rear surface 54 of the brake shoe housing 16. Furthermore, the key projection 58 in the cam opening 36 engages the groove 70 of the cam element 18. This interconnection helps retain the cam element 18 in place, while still enabling the cam element 18 to rotate within the cam opening 36. The length of the groove 70 and the presence of the flat ridge 50 within the cam opening 36 limit the range of rotation achievable by the cam element 18 in the cam opening 36. In this manner, the over rotation of the cam element 18 can be prevented.

The narrow side 68 of the cam element 18 is positioned toward the bottom of the brake shoe housing 16. This causes the tilt post receiving slot 66 to lie close to the thin bottom section 34 of the brake shoe housing 16. The tilt post receiving slot 66 receives the tilt post 22. Consequently, the tilt post 22 of the window sash 12 is held close to the thin bottom section 34 of the brake shoe housing 16. The result is that the window sash 12 can move to a lower position in the window frame than prior art brake shoe assemblies that support tilt posts in cams near the center of the brake shoe housing.

Figure 5:
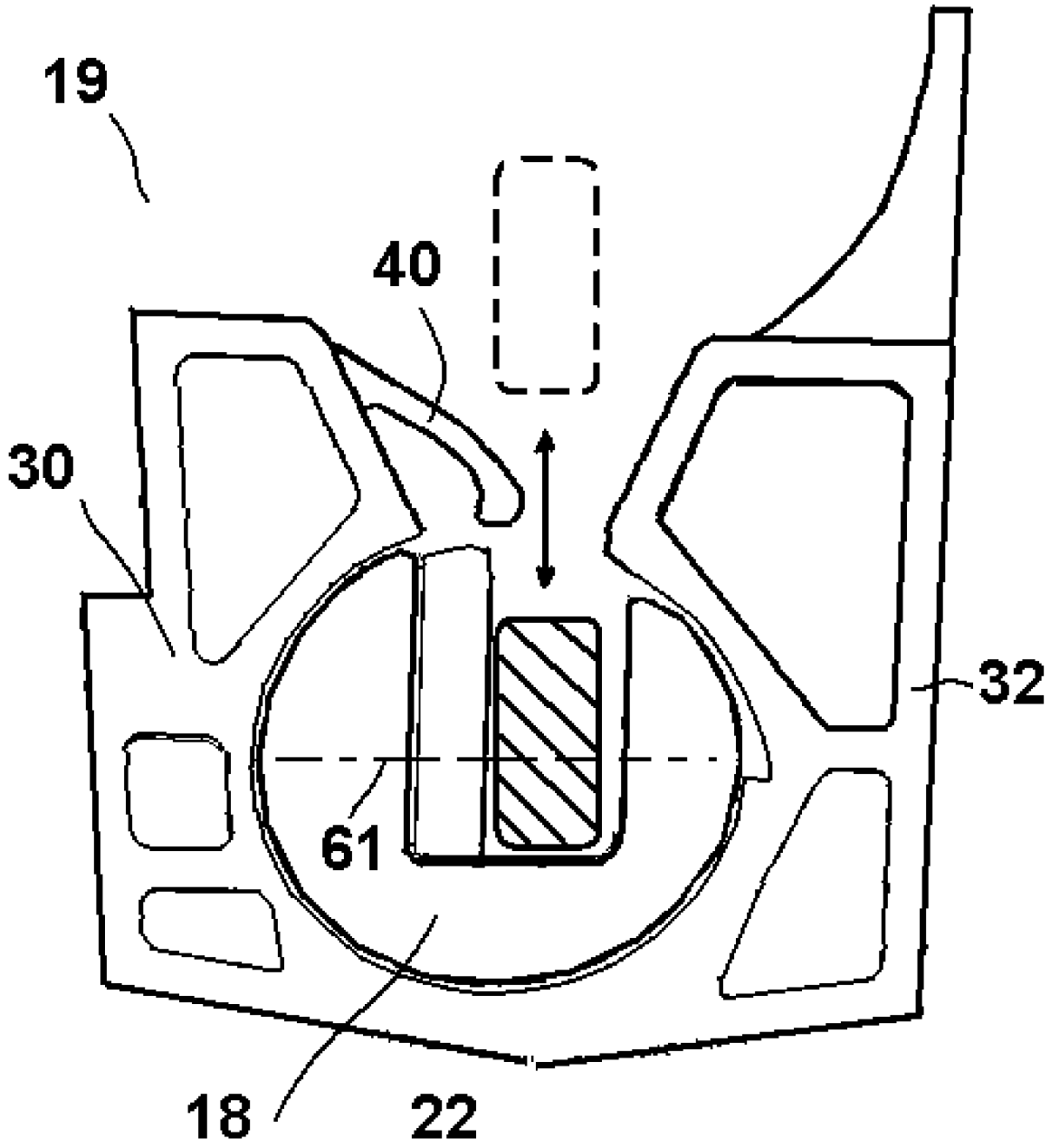
FIG. 5 is a front view of the brake shoe housing and cam element shown with the cam element holding a tilt post of a tilted window sash.

Referring to FIG. 5 in conjunction with FIGS. 1-4, it can be seen that when the window sash 12 is tilted inwardly, the tilt posts 22 of the window sash 12 causes the cam element 18 to turn. Prior, the long axis 61 of the cam element 18 has been vertically oriented. When the window sash 12 is tilted, that orientation changes toward the horizontal. The cam element 18 is oblong in shape since it has a long axis 61 and short axis 63. Consequently, when the cam element 18 turns, the cam element 18 spreads the first arm element 30 away from the second arm element 32 of the brake shoe housing 16. As the cam element 18 spreads the brake shoe housing 16, the brake shoe housing 16 flexes in its bottom section 34. The first arm element 30 and the second arm element 32 engage the side walls 27, 28 of the track 24. The result is that the brake shoe assembly 19 becomes locked in position within the guide track 24.

As the cam element 18 spreads open the brake shoe housing 16, the gap space 38 between the first arm element 30 and the second arm element 32 increases. The tilt post 22 can therefore be removed from the cam element 18 through the widened gap space 38. Removal of the cam element 18 in such a manner is hindered by the presence of the catch finger 40. The catch finger 40 extends into the gap space 38 and provides a physical barrier that prevents the tilt post 22 from exiting the cam element 18. In this manner, the catch finger 40 prevents a user from inadvertently pulling the tilt post 22 out of the cam element 18 while tilting the window sash 12 inwardly.

It will be understood that if the window sash 12 is broken or otherwise is intended to be removed from the window assembly, such a removal is possible. A person intending to remove the window sash 12 can simply depress the catch finger 40 while pulling up on the window sash 12. If the catch finger 40 is depressed, it will not block the gap space 38 above the tilt post 22 and the tilt post 22 can be freely removed.

Alternately, since the receiving slot 66 that retains the tilt post 22 is eccentrically positioned toward the narrow side 68 of the cam element 18, it will be understood that the catch finger 40 will not align directly above the tilt post 22. Rather, as is shown in FIG. 5, the enlarged free end 44 of the catch finger 40 aligns above one side of the tilt post 22. This enables the catch finger 40 to prevent most accidental removals of the tilt post 22. However, if the window sash 12 is pulled upwardly with a sufficient and determined force, the tilt post 22 will contact the catch finger 40 at an angle. Provided the upward force exceeds a predetermined threshold force of at least five pounds, for example, the catch finger 40 will then elastically yield to the tilt post 22 and the window sash 12 can be removed. Once the window sash 12 is removed, the temporarily displaced catch finger 40 will return to its original position. In this manner, a serviceman or homeowner can intentionally pull the window sash 12 out of the window assembly without any tools or manual brake shoe manipulations. The requirement of sufficient and sustained force required for the removal eliminates most all inadvertent removals of the window sash 12.

FIGS. 2 and 4 show the brake shoe housing 16, cam element 18 and tilt post 22 when the window sash 12 is vertical and in its regular operating position. FIG. 5 shows the brake shoe housing 16, cam element 18 and tilt post 22 when the window sash 12 is tilted and the brake shoe housing 16 is locked in the guide track 24. The shape of the cam opening 36 varies between the regular operating position of FIG. 4 and the locked position of FIG. 5. As can be seen from FIG. 4 and FIG. 5, the shape of the cam element 18 is designed to more precisely fit the cam opening 36 when the cam opening 36 is in its locked position. The result is fewer gaps 75 where no contact exists. In this manner, the cam opening 36 better engages the brake shoe housing 16 and is more resistant to accidental replacement while the window sash 12 is being tilted in. This helps prevent the cam element 18 from being advertently pulled, pushed or otherwise displaced from the brake shoe housing 16.

In the shown embodiment, the coil spring 20 attaches to the first arm element 30 of the brake shoe housing 16. This causes the brake shoe housing 16 to have a rotational bias in the clockwise direction as it travels up and down the guide track 24. To prevent the brake shoe housing 16 from cocking in the guide track 24, the second arm element 32 is provided with an extension 72. The extension 72 elongates the second arm element 32 and provides more surface contact with the side walls 27, 28 of the window guide track 24. This extended contact prevents the brake shoe assembly 19 from cocking to the bias of the coil spring 20 and binding in the guide track 24.

Figure 6:
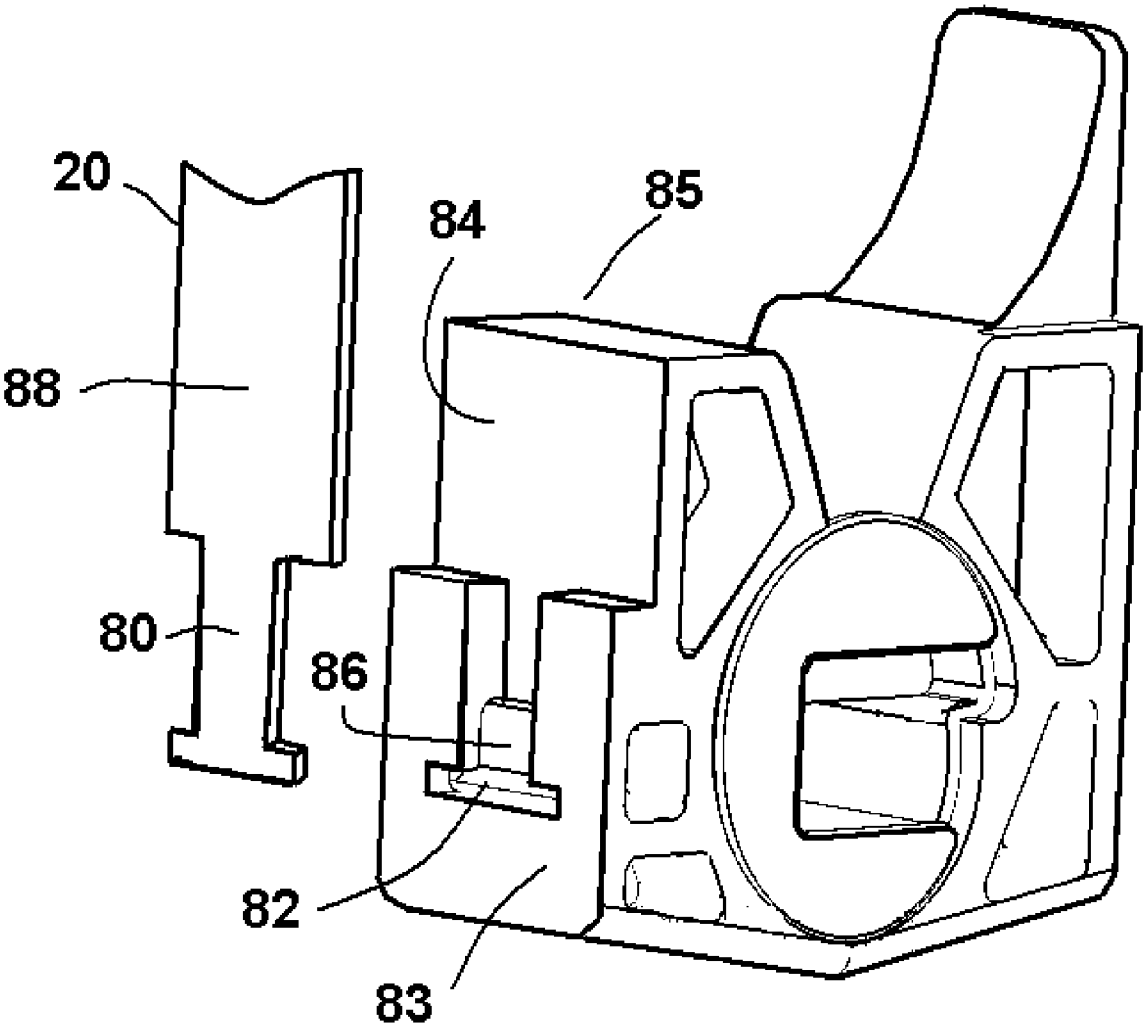
FIG. 6 is a perspective view of the brake shoe assembly and the free end of the coil spring to show interconnection features.
Figure 7:
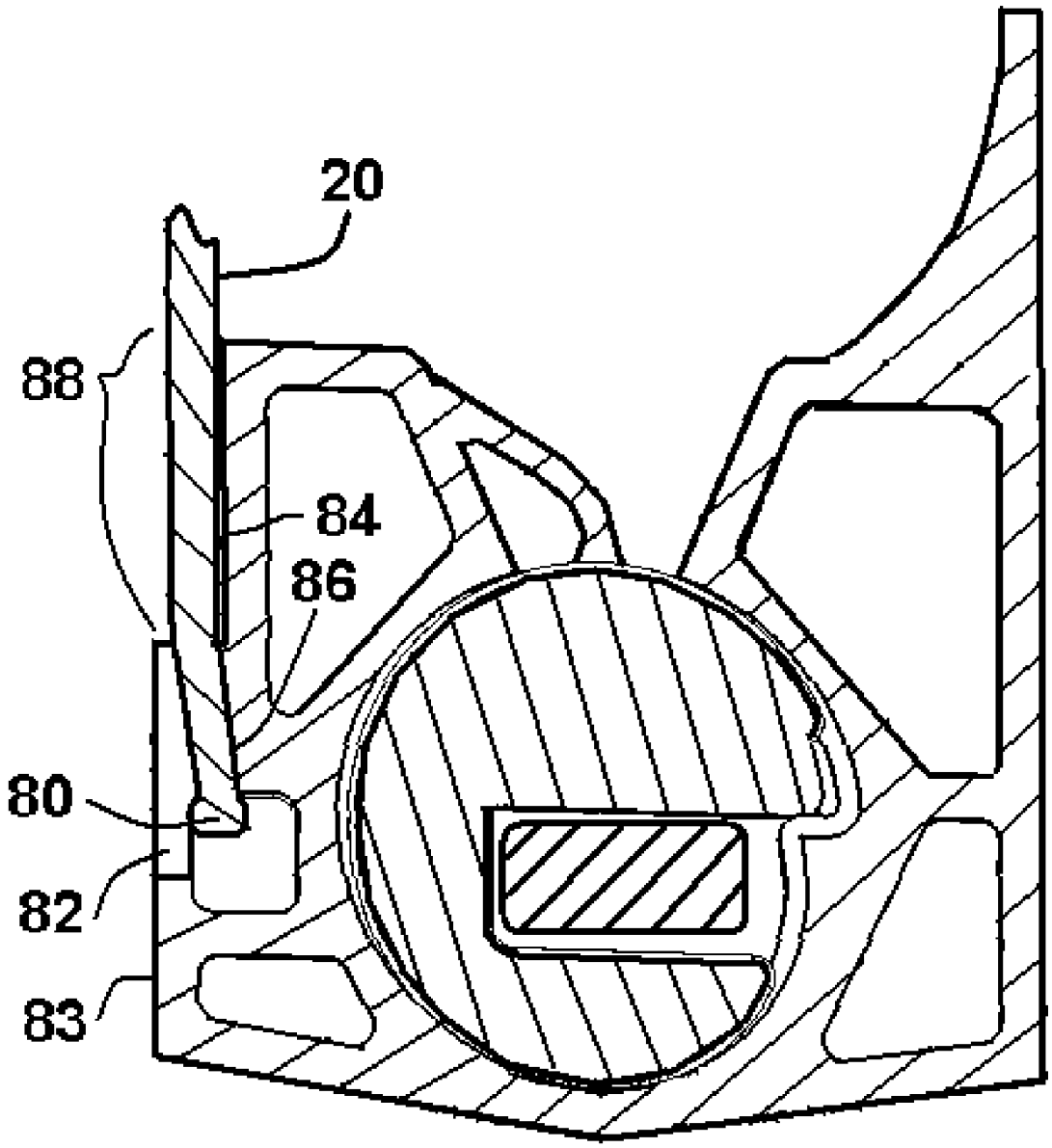
FIG. 7 is a cross-sectional view of the subassembly of FIG. 6.

Referring to FIG. 6 and FIG. 7, it can be seen that the coil spring 20 terminates with a T-shaped head 80. The T-shaped head 80 interconnects with the first arm element 30 of the brake shoe housing 16. The first arm element 30 of the brake shoe housing 16 is specially designed to receive the T-shaped head 80 of the coil spring 20 so as to reduce fatigue stresses in the coil spring 20.

A receptacle slot 82 is formed in a side wall 83 of the first arm element 30. The receptacle slot 82 is sized to receive and retain the T-shaped head 80 of the coil spring 20. A relief area 84 is formed in the side wall 83 of the first arm element 30 just above the receptacle slot 82. The receptacle slot 82 has a transition section 86 that smoothly leads the receptacle slot 82 into the relief area 84. When the coil spring 20 is engaged with the brake shoe housing 16, the T-shaped head 80 of the coil spring 20 enters the receptacle slot 82, therein mechanically interconnecting the coil spring 20 with the brake shoe housing 16. Once in this position, a length of the coil spring 20 proximate the T-shaped head 80 lays flush in the relief area 84. As a consequence, both the T-shaped head 80 of the coil spring 20, and a segment of spring 88 behind the T-shaped head 80 rest against the structure of the brake shoe housing 16 while the window assembly is in operation. The T-shaped head 80 of the coil spring 20 has a predetermined length L1. The segment of spring 88 supported in the relief area 84 is preferably at least as long as the length L1 of the T-shaped head 80.

The T-shaped head 80 of the coil spring 20 is much narrower than the remainder of the coil spring 20. As such, as a window sash 12 (FIG. 1) is opened and closed, changing tension forces and even some compression forces can be experienced by the coil spring 20. These changing forces create stresses that tend to concentrate in the thin T-shaped head 80 of the coil spring 20. The stresses fatigue the metal of the coil spring 20 and can eventually cause the T-shaped head 80 to break. By supporting both the T-shaped head and the segment of coil spring 88 behind the T-shaped head 80, the stress forces are prevented from concentrating in the T-shaped head 80. The result is that the coil spring 88 does experiences far less fatigue forces and therefore has a much longer operating life.

In order to accommodate both the receiving slot 82 and the relief area 84, the receiving slot 82 must be positioned low on the side wall 83 of the first arm element 30. Attaching the coil spring 20 to the brake shoe housing 16 at this low point of attachment has secondary advantages. The T-shaped head 80 of the coil spring 20 is generally horizontally aligned with the center of the cam element 18. Since the brake shoe housing 16 can rotate relative the cam element 18, this horizontal alignment minimizes the rotational torque experienced by the brake shoe housing 16. As a result, the cocking forces on the brake shoe housing 16 are minimized.

It will be understood that the embodiment of the present invention counterbalance system that is described and illustrated herein is merely exemplary and a person skilled in the art can make many variations to the embodiment shown without departing from the scope of the present invention. All such variations, modifications, and alternate embodiments are intended to be included within the scope of the present invention as defined by the appended claims.

What is claimed is:

1. A brake shoe assembly for use in a counterbalance system for a sash of a tilt-in window, wherein the sash has a tilt post, said brake shoe assembly comprising:

a brake shoe housing having a first arm element, a second arm element, and a bottom section that joins said first arm element to said second arm element, wherein a cam opening is disposed within said brake shoe housing and a gap space exists between said first arm element and said second arm element above said cam opening;

a cam element disposed within said cam opening, said cam element containing a tilt post receiving slot therein for receiving the tilt post of the sash, wherein said cam element can be selectively rotated within said brake shoe housing between a first orientation and a second orientation;

a catch finger extending from said first arm element into said gap space, said catch finger being integrally molded with said first arm element, wherein said catch finger extends from said first arm element and terminates at a free end, wherein said catch finger is molded into a first position that at least partially obstructs said tilt post receiving slot when said cam element is in said second orientation, and wherein said catch finger is flexible and resiliently deforms into a second position that does not at least partially obstruct said tilt post receiving slot when contacted by the tilt post when the sash is manually lifted from the tilt-in window.

2. The assembly according to claim 1, wherein said first arm element, said second arm element and said bottom section are integrally molded as a single piece of plastic.

3. The assembly according to claim 1, wherein said catch finger extends from said first arm element into said gap space and is angled down toward said cam opening when in said first position.

4. The assembly according to claim 1, wherein said bottom section is flexible and deforms to widen said gap space between said first arm element and said second arm element when said cam element is rotated from said first orientation to said second orientation.

5. The assembly according to claim 1, wherein first arm element and said second arm element have tapered surfaces facing said gap space that lead into said cam opening.

6. The assembly according to claim 5, wherein said brake shoe housing is flexible and elastically deforms to enable said cam element to pass into said cam opening through said gap space.

7. The assembly according to claim 1, wherein said cam opening deforms from a first shape to a second shape when said cam element is rotated from said first orientation to said second orientation.

8. The assembly according to claim 1, wherein said cam element has a first flange at one end, a second flange at an opposite second end and a midsection there between.

9. The assembly according to claim 8, further including a groove on said midsection of said cam element and a projection extending into said cam opening from said brake shoe housing, wherein said projection engages said groove and limits said cam element when said cam elements rotates in said brake shoe housing.

10. The assembly according to claim 8, wherein said brake shoe housing has a face surface and a rear surface, wherein said cam opening extends through both said face surface and said rear surface, and wherein said cam opening has depressed ridges inset from said face surface and said rear surface for receiving said first flange and said second flange of said cam element, respectively.

11. The assembly according to claim 1, wherein said tilt post receiving slot is disposed in said cam element closer to said bottom section of said brake shoe housing than said gap space when said cam element is in said first orientation.

12. The assembly according to claim 1, wherein said cam element includes;

a flat front end;

a flat back end;

a midsection extending between said front end and said back end, wherein said midsection has an oblong cross-sectional profile with a first axis and a second axis;

wherein said tilt post receiving slot extends through said midsection from said flat front end to said flat back end, wherein said tilt post receiving slot is eccentrically positioned so as to be wider on one side of said second axis.

13. The assembly according to claim 12, further including a first flange at said front end and a second flange at said back end.

14. The assembly according to claim 12, further including a groove formed in an exterior surface of said midsection.

* * * * *